US005890970A

United States Patent [19]

Donati

[11] Patent Number: 5,890,970

[45] Date of Patent: Apr. 6, 1999

[54] GOLF CLUB SUPPORT FOR RAISING A GOLF CLUB GRIP ABOVE FAIRWAY OR GREEN

[76] Inventor: Don J Donati, 2085 Thorncroft Dr., Germantown, Tenn. 38138

[21] Appl. No.: 846,585

[22] Filed: Apr. 30, 1997

[51] Int. Cl.[6] ..... A63B 53/00; A63B 55/04; A63B 55/10

[52] U.S. Cl. ..... 473/282; 473/316; 248/156

[58] Field of Search ..... 473/282, 286, 473/316; 248/156, 511, 530

[56] References Cited

U.S. PATENT DOCUMENTS

| | | | |
|---|---|---|---|
| 1,197,298 | 9/1916 | McGregor | 248/96 |
| 4,545,579 | 10/1985 | McCain | 473/282 |
| 5,116,046 | 5/1992 | Pace . | |
| 5,171,015 | 12/1992 | Vale . | |
| 5,377,977 | 1/1995 | MacNeary | 1/4 |
| 5,401,019 | 3/1995 | Wissman et al. . | |
| 5,413,329 | 5/1995 | Hirsch | 473/282 |
| 5,482,247 | 1/1996 | Smith | 473/282 |
| 5,492,230 | 2/1996 | Horton . | |

*Primary Examiner*—Sebastiano Passaniti
*Assistant Examiner*—Stephen L. Blau
*Attorney, Agent, or Firm*—Walker, McKenzie & Walker, P.C.

[57] ABSTRACT

A golf club support for raising a golf club grip above a golf green or fairway. The golf club support comprises an elongated support member having a distal end. The support member is hingedly attached to the golf club shaft intermediate the golf club head and the golf club grip. The support member is moveable between a first position, in which the distal end of the support member is remote from the golf club shaft so that the golf club grip is supported above the golf green or fairway, and a second position in which the distal end of the support member is proximate the golf club shaft. The golf club support includes a coiled spring for biasingly urging the support member to the second position when the golf club grip is not being supported above the golf green or fairway.

5 Claims, 2 Drawing Sheets

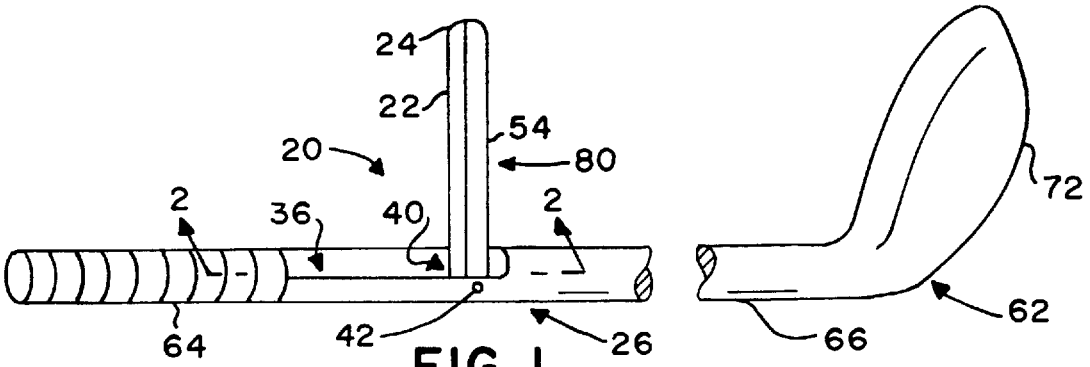
FIG. 1
FIG. 2
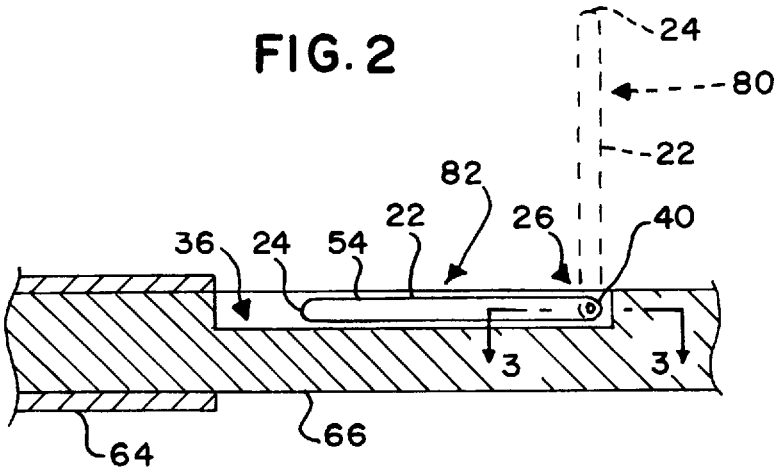
FIG. 3
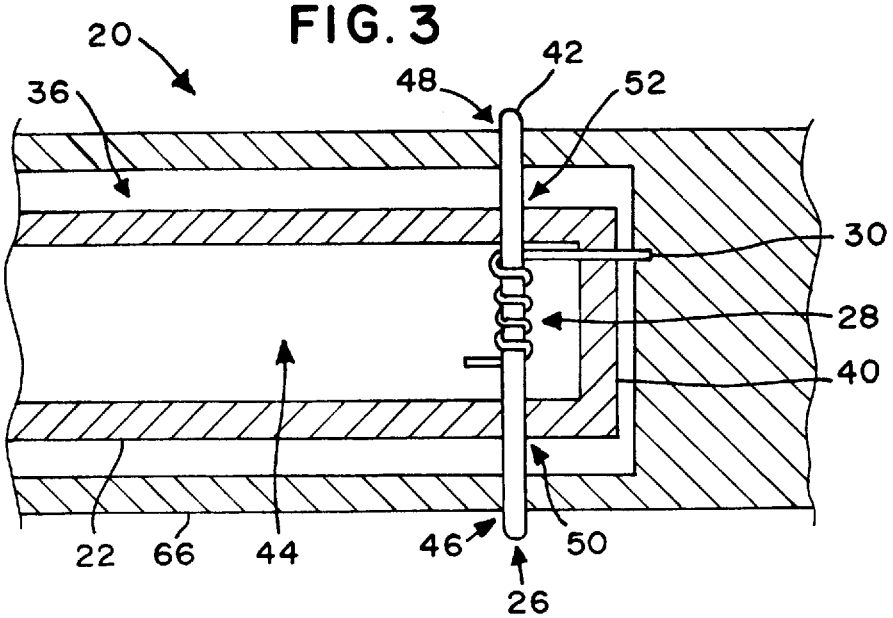

GOLF CLUB SUPPORT FOR RAISING A GOLF CLUB GRIP ABOVE FAIRWAY OR GREEN

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention relates, in general, to a golf accessory, and in particular, to a golf club support for raising a golf club grip above a fairway or green.

2. Information Disclosure Statement

It is often desirable to rest a golf club on a golf fairway or green in a manner so that the grip of the golf club does not receive moisture or dirt from the fairway or green. One well known solution to this problem is to provide a golf club which includes a grip having a small hole adapted to receive the tip end of a tee. The tee is supported on the fairway or green and acts to raise the grip of the golf club above the fairway or green. Another well known solution is to provide a stand with collapsible legs and with an opening adapted to receive a portion of the shaft adjacent the head of the golf club. Other stands which lift the golf club grip above the fairway or green are also well known in the art. These prior art devices require a golfer to carry additional pieces of equipment, namely, the supports or stands, which are separate from the golf club itself. These additional pieces of equipment are inconvenient for the golfer to carry while playing golf and can easily be misplaced.

A preliminary patentability search in Class 273, subclasses 32B, 32E, 80R, 81D and 162R, produced the following patents, some of which may be relevant to the present invention: Horton, U.S. Pat. No. 5,492,230, issued Feb. 20, 1996; Wissman et al., U.S. Pat. No. 5,401,019, issued Mar. 28, 1995; MacNeary, U.S. Pat. No. 5,377,977, issued Jan. 3, 1995; Vale, U.S. Pat. No. 5,171,015, issued Dec. 15, 1992; and Pace, U.S. Pat. No. 5,116,046, issued May 26, 1992. None of these references, either singly or in combination, disclose or suggest the present invention.

BRIEF SUMMARY OF THE INVENTION

The present invention is a golf club support for raising a golf club grip above a fairway or green. The golf club support comprises an elongated support member having a distal end. The support member is hingedly attached to a golf club shaft intermediate the golf club head and the golf club grip, and is moveable between a first position, in which the distal end of the support member is remote from the golf club shaft so that the golf club grip is supported above the fairway or green, and a second position in which the distal end of the support member is proximate the golf club shaft.

It is an object of the present invention to provide a golf club support for raising a golf club grip above a fairway or green so that the golf club grip does not contact the fairway or green and thereby remains dry and clean.

It is an additional object of the present invention to provide an embodiment which can be constructed within the shaft of a golf club.

It is an additional object of the present invention to provide another embodiment which includes a longitudinally extending tongue adapted for extending between the grip and shaft of a standard golf club.

It is an additional object of the present invention to provide spring means to biasingly urge the distal end of a support member to a position proximate the golf club shaft.

BRIEF DESCRIPTION OF THE SEVERAL VIEWS OF THE DRAWING

FIG. 1 is a perspective view of a first preferred embodiment of the present invention showing a support member moved to a first position.

FIG. 2 is a partial sectional view of the present invention taken along the line 2—2 of FIG. 1, showing the support member moved to a second position and showing the support member in dashed outline to illustrate hinged movement of the support member to the first position.

FIG. 3 is an enlarged partial top view of the present invention taken along the line 3—3 of FIG. 2, showing spring means biasingly urging the support member to the second position, and showing a hinge pin attaching the support member to a golf club.

DETAILED DESCRIPTION OF THE INVENTION

Figure 4:
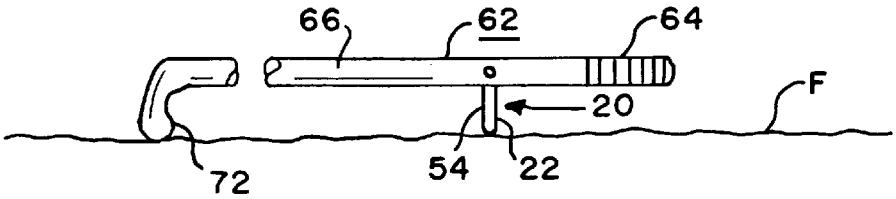
FIG. 4 is a view of the environment of the present invention showing the support member moved to the first position and inserted into a fairway or green to support a golf club grip above the fairway or green.

Referring to FIGS. 1–4, a first embodiment of a golf club support 20 for raising a golf club grip 64 of a golf club 62 above a golf green or fairway F is seen to comprise an elongated support member 22 having a distal end 24 and a proximal end 40. It shall be understood that the term "fairway", as used herein, is broadly meant to include golf fairways, driving ranges, golf greens, and/or other extents of land on which the sport of golf is played. The golf club support 20 is also seen to comprise attachment means 26 for hingedly attaching the support member 22 to the golf club shaft 66 intermediate the golf club head 72 and the golf club grip 64. Attachment means 26 allows the support member 22 to be moveable between a first position 80, in which the distal end 24 of the support member 22 is remote from the golf club shaft 66 so that the golf club grip 64 is supported above the fairway F, and a second position 82 in which the distal end 24 of the support member 22 is proximate the golf club shaft 66.

In the first preferred embodiment, the golf club shaft 66 is modified from prior art golf club shafts so as to be hingedly attached to the support member 22. FIG. 1, a perspective view of a first preferred embodiment of the present invention, shows the support member 22 moved to the first position 80 and shows attachment means 26 hingedly attaching the support member 22 to the golf club shaft 66. FIG. 2 is a partial sectional view of the first preferred embodiment taken along the line 2—2 of FIG. 1, showing hinged movement of the support member 22 between the first position 80 and the second position 82. The support member 22 is illustrated in dashed outline showing the support member 22 moved to the first position 80, in which the distal end 24 is remote from the golf club shaft 66, and the support member 22 is illustrated with solid lining showing the support member 22 moved to the second position 82, in which the distal end 24 is proximate the golf club shaft 66.

FIG. 3, an enlarged partial top view of the first preferred embodiment of the present invention taken along line 3—3 of FIG. 2, shows a preferred embodiment of attachment means 26. Attachment means 26 is seen to preferably comprise a pair of first opposing holes 46, 48 which transversely extend through the golf club shaft 66, and a pair of second opposing holes 50, 52 which transversely extend through the support member 22. Attachment means 26 is seen to further preferably comprise a hinge pin 42 which extends through the first opposing holes 46, 48 and through the second opposing holes 50, 52 to hingedly mount the support member 22 to the golf club shaft 66.

The golf club shaft 66 preferably has a longitudinal channel 36 adapted to receive the support member 22 therein. The golf club support 20 preferably includes spring means 28 for biasingly urging the support member 22 to the second position 82 when the golf club grip 64 is not being supported above the fairway F. The spring means 28 preferably comprises a coiled spring 30, but may comprise a leaf spring, any one of various suitable springs known in the art, or any other similar device for biasingly urging the support member 22 to the second position 82 when the golf club grip 64 is not being supported above the fairway F, as will now be apparent to those skilled in the art. Support member 22 preferably has a cavity 44 adapted to receive coiled spring 30, and coiled spring 30 preferably circumferentially surrounds the hinge pin 42 within the cavity 44.

FIG. 4 is a view of the environment of the present invention showing the support member 22 moved to the first position and inserted into a fairway F to support the golf club grip 64 above the fairway F.

Referring to FIGS. 1–4, to use the first embodiment of the present invention, a golfer simply grasps the edge 54 of the support member 22, moves the support member 22 to the first position 80, and then implants the distal end 24 of the support member 22 into the fairway F. The head 72 of the golf club 62 and the support member 22 act to support the golf club 62 and raise the golf club grip 64 above the fairway F, thereby preventing the golf club grip 64 from coming into contact with moisture or dirt on the fairway F and thus keeping the golf club grip 64 dry and clean.

Figure 5:
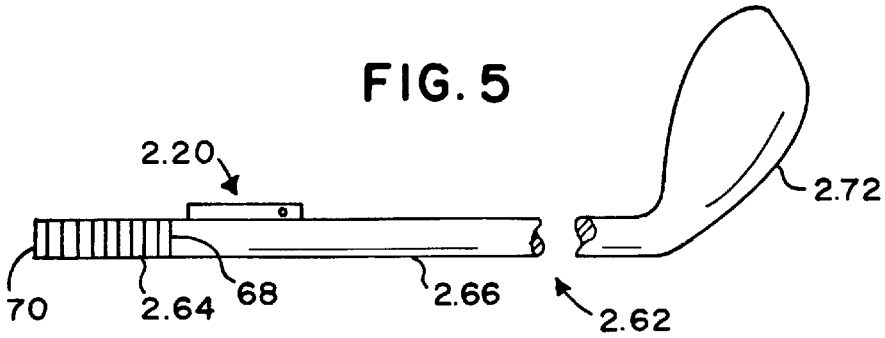
FIG. 5 is a side view of a second preferred embodiment of the present invention showing the second preferred embodiment attached to a standard golf club.
Figure 6:
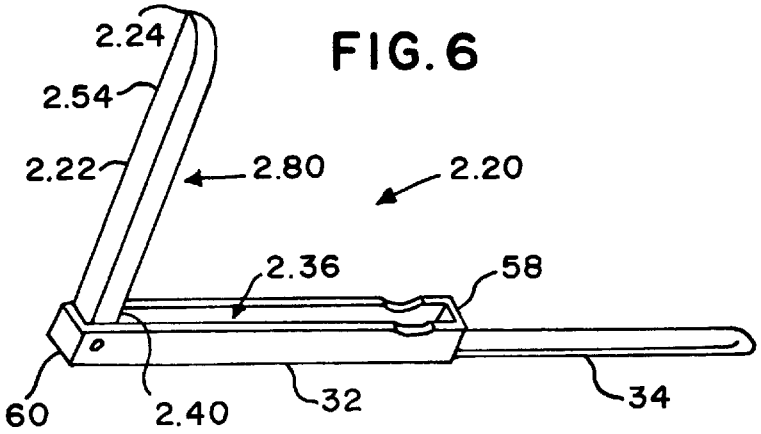
FIG. 6 is a perspective view of a second preferred embodiment of the present invention showing a body portion and a tongue adapted for extending between the grip and shaft of a standard golf club.
Figure 7:
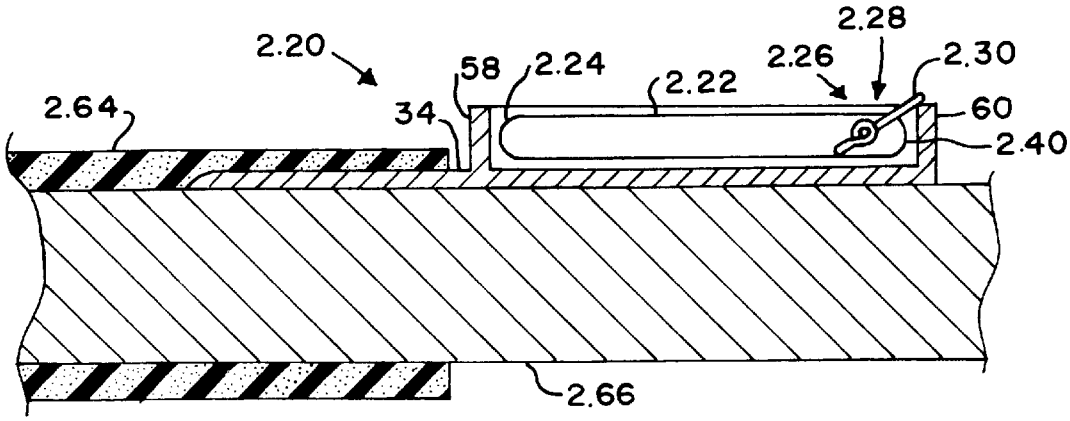
FIG. 7 is an enlarged partial sectional view of the second preferred embodiment shown in FIG. 5 and taken along a diameter thereof, showing the tongue extended between the grip and shaft of a standard golf club.

A second preferred embodiment of the present invention is shown in FIGS. 5–7. Identifying reference designators are marked similarly to the first preferred embodiment, except with the prefix "2.". It shall be understood that many aspects of the two embodiments are substantially the same, and only the differences will be treated in detail, it being understood that similar structural features of all the embodiments perform similar functions. FIG. 5 is a perspective view showing the second preferred embodiment of the golf club support 2.20 secured to a standard golf club 2.62. The support member 2.22 is biased in the second position and is hidden in the view shown in FIG. 5. The second preferred embodiment of the golf club support 2.20 is designed to be used with a standard golf club 2.62, so that no modification of the standard golf club 2.62 is necessary. The standard golf club 2.62 includes a golf club grip 2.64 which has two ends, one defining a first end 68 of grip 2.64 that is remote from the golf club head 2.72, and the other defining a second end 70 of grip 2.64 that is more remote from the golf club head 2.72 than the first end 68.

FIG. 6 is a perspective view showing the second preferred embodiment of the golf club support 2.20 in greater detail than in FIG. 5. Referring to FIG. 6, the golf club support 2.20 is seen to comprise a body portion 32 which includes a tongue 34 longitudinally extending from the body portion 32 and adapted for extending between the golf club grip 2.64 and the golf club shaft 2.66 of a standard golf club 2.62. The body portion 32 preferably has a first end 58 and a second end 60 remote from the first end 58 of body portion 32. The tongue 34 preferably extends from the first end 58 of body portion 32, but may extend from other areas of the body portion 32. The support member 2.22 has an edge 2.54, which can be grasped by a golfer to move the support member from the first position to the second position 2.54. The support member 2.22 has a distal end 2.24 and a proximal end 2.40 remote from the distal end 2.24. The proximal end 2.40 of the support member 2.22 is hingedly attached to the body portion 32, preferably adjacent the second end 60 of the body portion 32. The body portion 32 preferably has a longitudinal channel 2.36 therein for receiving the support member 2.22 when the support member 2.22 is urged in the second position by spring means 2.28, shown especially in FIG. 7.

FIG. 7 is an enlarged partial sectional view of the second preferred embodiment shown in FIG. 5 and taken along a diameter thereof, showing the tongue 34 extending between the golf club grip 2.64 and the golf club shaft 2.66. Referring to FIGS. 5–7, the golf club support 2.20 can be secured to a standard golf club 2.62 having a golf club grip 2.64 by sliding the tongue 34 between the first end 68 of the golf club grip 2.64 and the golf club shaft 2.66 and by exerting sliding force until the tongue 34 is securely extended between the golf club grip 2.64 and the golf club shaft 2.66. Alternatively, tongue 34 could be placed adjacent shaft 2.66 while the grip 2.64 is affixed to shaft 2.66, thereby entrappingly securing tongue 34 between grip 2.64 and shaft 2.66.

As with the first embodiment, to use the second embodiment of the present invention, a golfer grasps the edge 2.54 of the support member 2.22 and moves the support member 2.22 to the first position 2.80. The golfer then implants the distal end 2.24 of the support member 2.22 into the fairway F in a manner similar to that shown with the first embodiment in FIG. 4. The head 2.72 of the golf club 2.62 and the support member 2.22 act to support the golf club 2.62 and raise the golf club grip 2.64 above the fairway F, thereby preventing the golf club grip 2.64 is from coming into contact with moisture or dirt on the fairway F and thus keeping the golf club grip 2.64 dry and clean.

Although the present invention has been described and illustrated with respect to a preferred embodiment and a preferred use therefor, it is not to be so limited since modifications and changes can be made therein which are within the full intended scope of the invention.

I claim:

1. In combination, a golf club and a golf club support for raising a grip of said golf club above a fairway, said golf club having a head and a shaft with said grip therearound, said support comprising:

(a) an elongated support member having a distal end;

(b) a body portion and a tongue longitudinally extending from said body portion and extending between said grip and said shaft; and, (c) attachment means for hingedly attaching said support member to said body portion and for allowing said support member to be moveable between a first position, in which said distal end of said support member is remote from said shaft for supporting said grip above the fairway, and a second position in which said distal end of said support member is proximate said shaft.

2. The combination as recited in claim 1, in which said body portion has a first end, and said tongue extends from said first end.

3. The combination as recited in claim 2, in which said support member has a proximal end remote from said distal end, said body portion has a second end remote from said first end of said body portion, and said proximal end of said support member is hingedly attached to said body portion adjacent said second end of said body portion.

4. The combination as recited in claim 1, in which said golf club support further includes spring means for biasingly urging said support member to said second position when said grip is not being supported above the fairway, and said spring means comprises a coiled spring.

5. In combination, a golf club and a golf club support for raising a grip of a golf club above a fairway; said golf club having a head and a shaft with said grip therearound, said support comprising:

(a) a body portion having a first end and a second end remote from said first end of said body portion;

(b) a tongue longitudinally extending from said first end of said body portion and extending between said grip and said shaft;

(c) an elongated support member having a distal end and a proximal end;

(d) attachment means for hingedly attaching said proximal end of said support member adjacent to said second end of said body portion and for allowing said support member to be moveable between a first position, in which said distal end of said support member is remote from said shaft for supporting said grip above the fairway, and a second position in which said distal end of said support member is proximate said shaft; said attachment means including a hinge pin hingedly mounting said support member to said body portion; and (e) a coiled spring for biasingly urging said support member to said second position when the grip is not being supported above the fairway, said body portion having a longitudinal channel therein for receiving said support member when said support member is urged to said second position.

* * * * *